United States Patent [19]

Parron et al.

[11] Patent Number: 4,677,794

[45] **Date of Patent: * Jul. 7, 1987**

[54] SUPPORT ASSEMBLY FOR A SHELF OR LIKE STRUCTURE

[76] Inventors: Ivan Parron, 133 W. 23rd St., Hialeah, Fla. 33010; Michael R. Rosenthal, 6001 SW. 118 St., Miami, Fla. 33156

[ * ] Notice: The portion of the term of this patent subsequent to May 29, 2001 has been disclaimed.

[21] Appl. No.: 570,935

[22] Filed: Jan. 16, 1984

Related U.S. Application Data

[63] Continuation-in-part of Ser. No. 411,439, Aug. 25, 1982, Pat. No. 4,450,655.

[51] Int. Cl.[4] ..... A47B 5/00

[52] U.S. Cl. ..... 52/36; 52/710; 248/222.3

[58] Field of Search ..... 52/36, 710, 272, 285, 52/582, 584; 248/222.1, 222.2, 222.3, 225.1, 297.2; 211/87, 94, 103, 105.3, 193, 207

[56] References Cited

U.S. PATENT DOCUMENTS

| | | | |
|---|---|---|---|
| 1,661,188 | 3/1928 | Matthews | 248/222.3 |
| 2,079,478 | 5/1937 | Bashe | 52/710 |
| 2,733,330 | 1/1956 | Blewett | 248/297.1 |
| 2,736,527 | 2/1956 | Maier | 248/297.2 |
| 2,754,166 | 7/1956 | Ohm | 211/95 |
| 2,784,812 | 3/1957 | Kindorf | 403/222 |
| 2,931,853 | 4/1960 | Wilson | 248/297.5 |
| 2,940,718 | 6/1960 | Beal | 269/54.1 |
| 4,161,303 | 7/1979 | Bachand | 248/246 |
| 4,253,633 | 3/1981 | Takegawa | 248/222.3 |
| 4,443,979 | 4/1984 | Varon et al. | 52/36 |
| 4,450,655 | 5/1984 | Rosenthal et al. | 52/36 |
| 4,523,683 | 6/1985 | Fullenkamp et al. | 211/190 |
| 4,560,130 | 12/1985 | Schwartz | 248/297.2 |

FOREIGN PATENT DOCUMENTS

| | | | |
|---|---|---|---|
| 1183878 | 7/1959 | France | 211/103 |
| 21629 | 9/1907 | United Kingdom | 52/710 |
| 751485 | 6/1956 | United Kingdom | 248/222.1 |

*Primary Examiner*—John E. Murtagh
*Assistant Examiner*—Andrew Joseph Rudy
*Attorney, Agent, or Firm*—Kenyon & Kenyon

[57] ABSTRACT

A support assembly including a clamp assembly and support bar designed to be removably mounted in one of a plurality of vertically oriented slots in a mounting panel wherein a clamp assembly includes a keeper bar dimensioned and configured for placement on the interior pocket portion of one of the slots in movable, cooperative relation to a force distribution plate disposed in flush, abutting engagement with the exterior surface of the mounting panel and in overlapping relation to an entrance or throat portion of the slot, the latter being of lesser width than the pocket portion as well as the length of the keeper bar to prevent inadvertent removal therefrom. A connecting element interconnects the keeper bar to the fourth plate wherein relative movement therebetween provides a clamping action on the mounting panel in the area of the entrance to the vertical slot. Such clamping action serves to secure a support bar extending outwardly from an exposed face of the force distribution plate wherein the support bar is dimensioned and configured for supporting shelf-like structures used in commercial display and like application.

14 Claims, 9 Drawing Figures

SUPPORT ASSEMBLY FOR A SHELF OR LIKE STRUCTURE

This is a continuation-in-part application of presently pending application Ser. No. 411,439 filed on Aug. 25, 1982 now U.S. Pat. No. 4,450,655.

FIELD OF THE INVENTION

This invention relates to a wall panel and more particularly to a vertically slotted wall panel in combination with a support arm and clamp assembly for attachment of the arm to the panel.

BACKGROUND OF THE INVENTION

In the past there have been numerous types of wall panels which are affixed to walls in buildings, for example, and some have been provided with laterally extending generally T-shaped slots wherein a throat is defined and an interior pocket is defined. A holder for an outwardly extending arm provides a transfer of the forces to the lips of the horizontally extending slot. Such a structure has often been utilized in department stores, for example, for displaying articles.

This invention is of an improved panel which is provided with vertical slots and an improved clamp assembly for fastening support arms to the panel at any height which is desired simply by moving the clamp assembly vertically.

SUMMARY OF THE INVENTION

This invention is of a vertically slotted panel and a clamp assembly which is slidably captivated within one of the vertical slots and which connects a support arm to it for supporting various articles, such as shelves.

OBJECTS OF THE INVENTION

It is an object of this invention to provide an improved combination composed of a rigid reinforced vertically slotted wall panel composed of a core of particle board sandwiched between plywood sheets and at least one outwardly extending support arm with an improved clamping mechanism for attaching the arm to the panel.

It is a more particular object of this invention to provide in combination a durable rigid reinforced panel and shelf support and clamp assembly wherein the panel is provided with vertically extending slots of common size opening defining a throat leading into an interiorly disposed pocket having vertical side, front and rear wall sections and which is sized to receive a pair of keeper bars fixed by screws to a force distribution plate to overlay the exterior of the panel and from which there extends a support arm and wherein the same may be readily adjusted vertically to vary the location of the shelf support arm and any articles to be located therein.

It is an overall object of this invention to provide a device of the type described hereinafter which is simple and inexpensive to manufacture, easy to construct and insall and which can be readily adjusted to suit the needs of a user and which is as described generally herein.

DESCRIPTION OF THE DRAWINGS

For a fuller understanding of the nature of the present invention, reference is had to the following drawings, in which.

Like reference characters refer to like parts throughout the several views of the drawings.

DESCRIPTION OF THE PREFERRED EMBODIMENT

Figure 1:
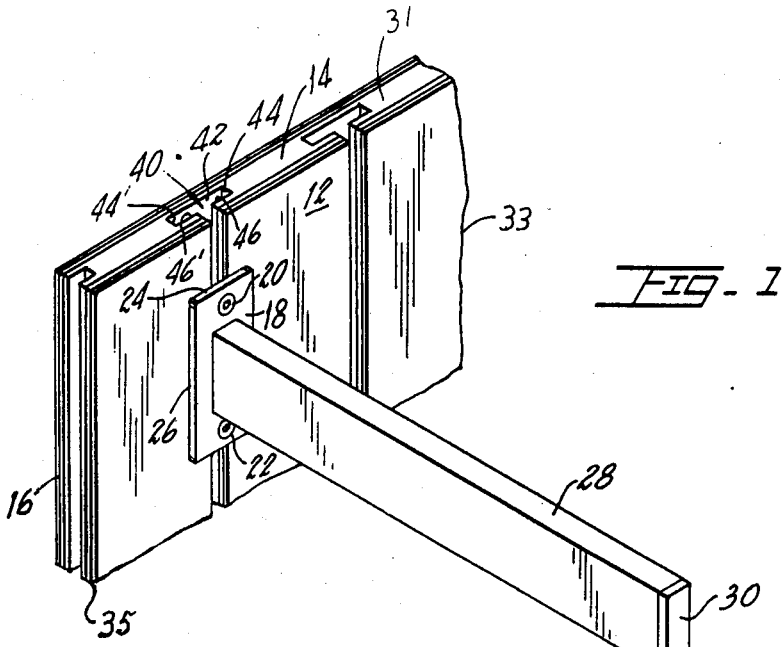
FIG. 1 is a perspective view of the panel and shelf support and clamp assembly.

Referring to the drawings wherein like reference characters designate like or corresponding parts throughout the several views and referring particularly to FIG. 1, the panel is generally designated by the numeral 12. It is seen to be composed of a sandwiched piece of particle board 14 between a front and rear sheet of plywood 15 and 1, the front sheet being covered by an outer skin 19 and, preferably, the rear sheet being covered by a rear skin 2B. The panel has an upper edge or face 31 and a side face 16 as well as an opposite side face 33 which generally designates the same and a lower face 35. It also has a front main face as illustrated and a rear main face to be positioned for example, on a wall and secured thereto.

Figure 2:
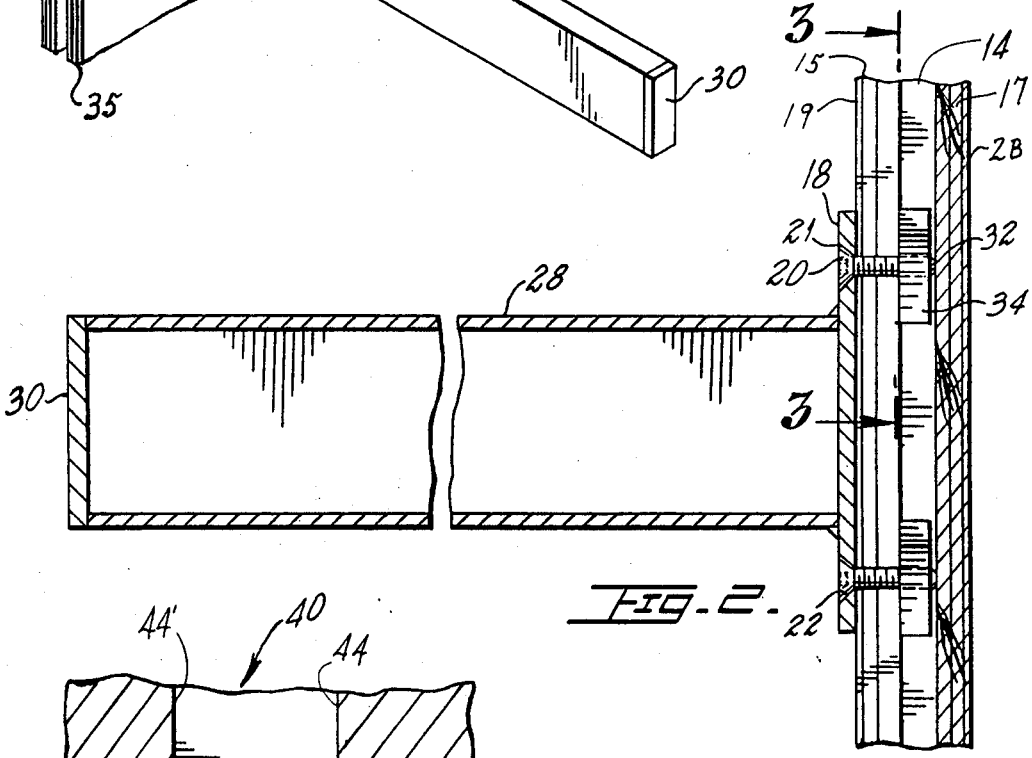
FIG. 2 is a view in cross section illustrating the panel shelf support and clamp assembly.
Figure 3:
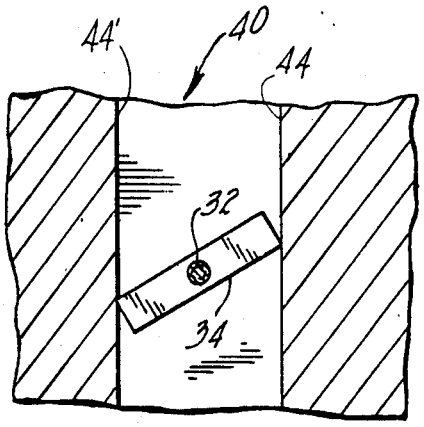
FIG. 3 is a view in cross section of that portion of FIG. 2 designated by the arrowed line 3—3 of FIG. 2 and looking in the direction of the arrows.
Figure 4:
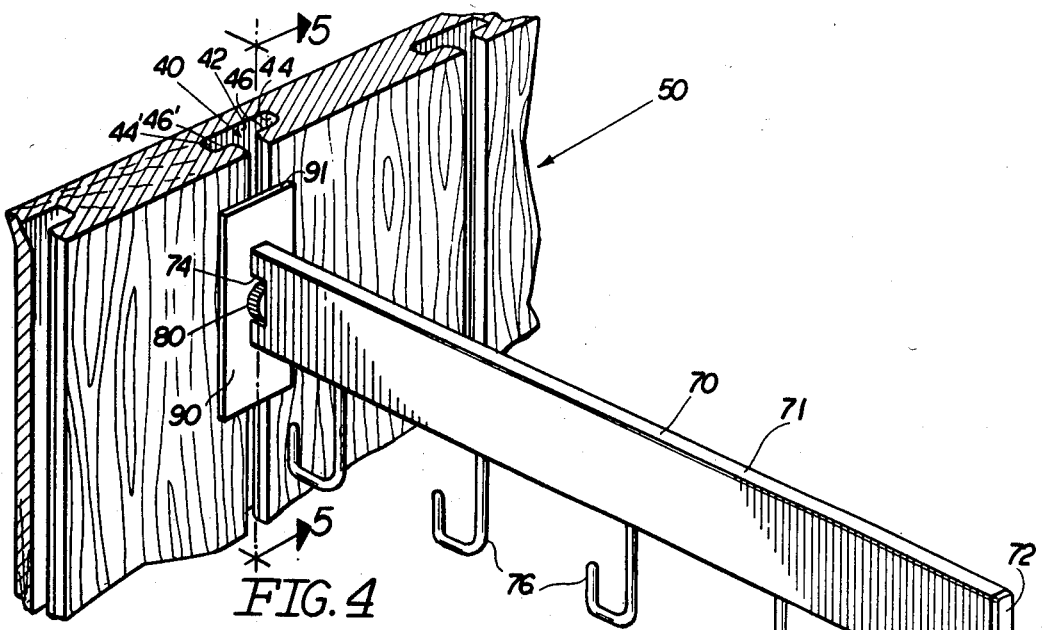
FIG. 4 is a perspective view of a panel and shelf support and clamp assembly mounted thereon.

It is thus seen that there is provided a rigid reinforced panel, the particle board being sandwiched between and rigidified and reinforced by the plywood and the outer skin providing a decorative surface, for example, a thin veneer of wood or plastic. Extending vertically from the top face completely to the bottom face there are a plurality of spaced vertically extending slots of common size opening in the front face and each of which extends from the front face depthwise perpendicularly of the front face into the particle board and defining a throat leading to an enlarged pocket 40 within the particle board which is bounded by a rear wall 42, opposing side walls 44 and 44' and front wall sections 46 and 46' thus defining by the wall section lips which are composed of a portion of the thickness of the particle board, the front plywood sheet and the outer skin. In the preferred embodiment, the lateral dimension of the throat is about $\frac{1}{4}$ inch, the depth of the throat, that is the thickness of the lips being about $\frac{1}{4}$ inch and the thickness of the pocket, that is the distance between the rear wall and front wall section being about $\frac{1}{4}$ inch, while the lateral dimension of the pocket is substantially greater than and at least three times the thickness of the throat and preferably about $\frac{3}{4}$ inch to about 1 inch. The pocket is of uniform cross section throughout its length between the top edge or surface and the bottom edge or surface of the panel. A shelf support and clamp assembly is provided for use in combination with the panel. As shown, this is composed of an arm 28 which extends perpendicular from the front face of the panel a predetermined distance and which is of a predetermined height and width. The arm 28 has an inner end at 18 and an outer end 30. The inner end is enlarged defining a force distribution plate 18 overlaying the panel and more particularly the lips on opposite sides of a slot. The outer end 30 includes a cap 31 disposed thereon to define a distal extremity of arm 28. The plate is of a width greater than the lateral dimension of the throat as indicated by the surface 24 and is of a height greater than the height of the arm as indicated by the edge 26, thus defining an upper zone and a lower zone. Each of these zones has a hole therethrough such as that indicated by the numeral 21 and 22 in FIG. 2 and in each of which there is a headed threaded screw 20 with the head being conically shaped for nested receipt within the countersunk hole as shown. As best seen in FIG. 3, a pair of keeper bars are provided in the pocket for each arm and each of these bars is of a length 34 greater than the distance between the pocket walls 44 and 44' and each of which has a threaded hole therein which accommodates the threaded shank 32 of the screw. Each of the screws extends through the force distribution plate or inner end of the arm and through the throat into threaded engagement with the keeper bars which are sized for receipt within the pocket as shown in FIG. 2. In use, when the screws are withdrawn slightly the arm including the force distribution plate may be adjusted vertically with respect to the vertical slots with the keeper bar remaining captivated within the slot and slidable together with the arm to a preselected position. When in position, the screws are tightened, which causes the keeper bars to rotate into the position shown in FIG. 3 where their surfaces bite into the opposing side walls of the pocket gripping it and thereafter, further tightening of the screws causes clamping to take place of the longitudinally extending vertical portions of the plate to the lips distributing any vertical forces applied to the arms along the length of both lips in the zone at which the shelf support is attached to the panel.

It is thus seen that there has been provided a support system for a shelf support arm which distributes the load over a substantial zone of the panel and over both lips which are relatively strong by reason of the plywood reinforcing in addition to the particle board and skin and which is readily and easily adjustable vertically to vary the location and arrangement of any displays which might be located on the panel, such as hi-fidelity electronic equipment, books, plants, or the like. The panel is decorative with or without the shelf support and clamp assemblies which can easily be removed from the bottom or the top where small space is provided for ease and withdrawal of the same and which may be covered by a molding or the like if desired.

For purposes of illustration, the screw end 32 is shown projecting from the keeper 34; however, it need not be that long. Indeed, in a preferred embodiment, the screw end is recessed in the keeper bar. Further, the face of the keeper bar confronting the rear wall of the pocket may be notched about the hole through the keeper bar defining outboard feet. Also, an anti-wobble guide means in the form of a sleeve about the screw shank sized for close reception in the throat may be provided. Optionally, the surface of the first distribution plate confronting the panel may have a portion which extends snugly yet slidably into the throat as a positioning guide.

As shown in FIGS. 4 through 9, the present invention comprises an additional embodiment wherein a support arm 70 is secured to and extends outwardly from an exposed face 90 of a force distribution plate 91. The support arm 70 includes an upper elongated edge or surface 71 specifically dimensioned to have a shelf or like structure mounted thereon when two or more of the support arms are disposed on vertically slotted panel 50 in spaced apart relation to one another. Other structural features of the support arm 70 include a closed distal end 72 and a plurality of support hangers 76 which may be formed in a hooked like configuration and which may be spaced apart from one another as they depend from the under surface thereof. The embodiment of FIGS. 4 through 7 is similar to that of the embodiment of FIG. 1 in that the clamp assembly to be described in detail hereinafter is designed to be movably mounted within one of a plurality of vertical slots 40 disposed in spaced apart relation to one another and extending preferably the entire or at least the majority of the length of the support panel 50. While not limited to specific measurements, it is preferred that the subject support panel 50 is used in sections each having a width of 48 inches and a height of 96 inches wherein the individual vertical slots are disposed in parallel relation to one another and extend the full length of each support panel section 50. Further, for maxiumum efficiency, the distances between each of the slots 40 may vary from between 3 to 4 inches or between 6 to 9 inches wherein such distance is measured between the center of the entrance 43 of each slot. Further structural features regarding the slot includes an interior having a somewhat enlarged pocket with common configuration and dimension extending along the length thereof. Each interior pocket of each slot has a rear face 42 and two front faces 46 and 46' which define inwardly directed spaced apart lips 45. These lips, being spaced apart, define entrance 43 wherein the width of entrance 43 is substantially less than the width of the interior or pocket of the slot 40. This width may be measured from side faces 40 and 44' disposed in opposite, spaced apart and substantially parallel relation to one another.

Based on the above, the clamp assembly includes the force distribution plate 91 having exterior or exposed surface 90 and interior surface 93. When mounted or clamped in supported position on panel 50, the inner surface 93 of force distribution plate 91 is disposed flush to the exterior or exposed surface 63 (see FIGS. 8 and 9) of the panel 50. Further, the force distribution plate has an overall width or transverse dimension substantially greater than the entrance 43 to each of the slots 40 and thereby is disposed in overlying relation to the entrance 43 of each of the slots at any point along the length thereof.

Figure 7:
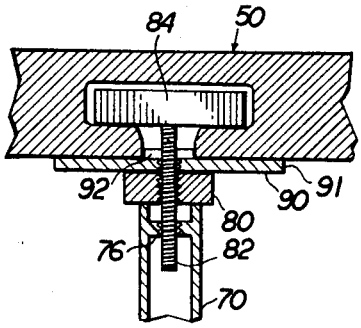
FIG. 7 is a sectional view along line 7—7 of FIG. 5.

The clamp assembly of the subject embodiment includes a connecting means comprising a first connector element 82 and a second connector element 80. The first connector element 82 is substantially of an elongated configuration and being externally threaded at least along a portion of the length thereof. A keeper bar means 84 is fixedly secured at the inner end of first connector element 82 so as to move therewith. When disposed in clamping position (FIG. 7), the keeper bar means 84 is disposed within the interior or pocket of the slot 40 at a predetermined height along the length thereof. In this embodiment, the keeper bar means 84 comprises a single keeper bar element connected at the inner end to the first connector element. The second connector element 80 is disposed in surrounding relation to the exterior threaded surface of the first connector element 82 and because of its internal threaded structure it is disposed in mating engagement therewith. Accordingly, upon rotation of the second connector element 80, the first connector element 82 is forced to move along its own longitudinal axis relative to the force distribution plate 91. This in turn moves the keeper bar means 84 also relative to the force distribution plate 91. Accordingly, rotation of the second connector element 80 relative to the first connector element 82 causes linear movement of connector element 82 as well as keeper bar means 84 towards the force distribution plate 91. As best shown in FIG. 7, the length of the keeper bar means 84 is greater than the width of the entrance means 43 to each of the slots 40. Also, the keeper bar means is arranged substantially transverse to the longitudinal axis of the slot 40 and to the length of the entrance means 43. Based on the above, a clamping action takes place about the lips 45 by the keeper bar means 84 on the interior of the slot 40 and by the force distribution plate 91 on the exterior of the slot 40. This securely mounts the entire clamp assembly in the desired position along the length of any of the given slots in which it is mounted. This also serves to maintain the support arm 71 in an outwardly extending relation to the exposed surface 90 of the force distribution plate 91. This in turn allows shelving to be placed on the upper portion 71 of support arm 70 or various items to be hung in depending fashion from the various hooks or support elements 76.

Figure 5:
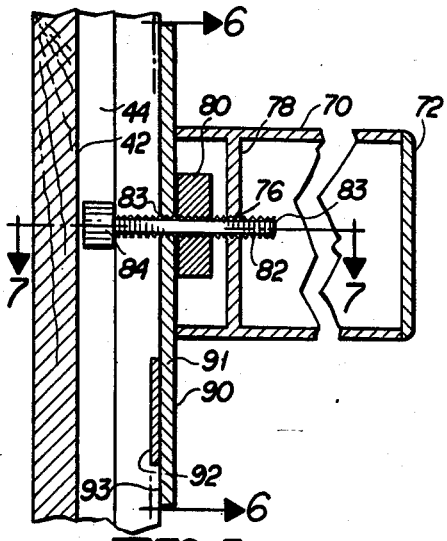
FIG. 5 is a sectional view along line 5—5 of FIG. 4 showing interior components of the clamp assembly.
Figure 6:
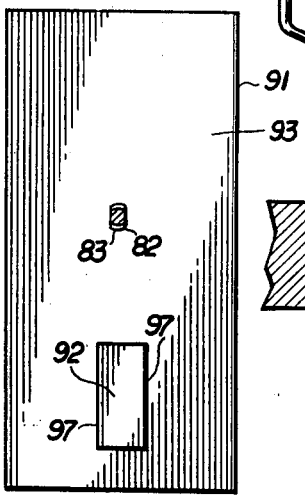
FIG. 6 is an end view of the interior surface of the force distibution plate including details of the centering structure thereon.

With reference to FIG. 6, this embodiment of the present invention comprises a centering means in the form of a centering plate 92 secured to and extending outwardly from the inner surface 93 of the force distribution plate 91. As shown in FIGS. 5, 6, and 7, the width of the force distribution plate 92 is almost equal to but somewhat less than the width of the entrance 43 of any of the slots 40. Therefore, the centering plate 92 passes into and is substantially aligned with the entrance 43 such that its longitudinal edges 97 come into contact with the longitudinal edges of the lips 45 preventing rotation of the force distribution plate 91 once it is clamped in flush, overlying relation to the entrance 43 as described above.

Figure 8:
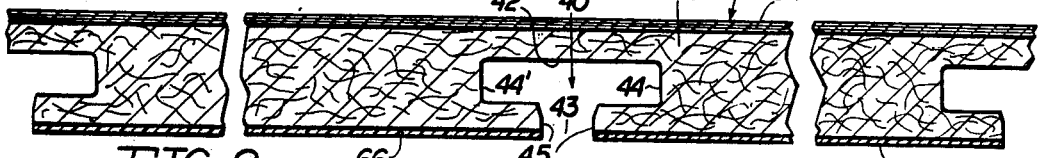
FIG. 8 is one embodiment of the panel structure of the present invention.

Further structural features of the present invention include the formation of the panel 50 from various components. As shown in FIG. 8, the interior or core of the panel may be formed from fiberboard or like substance 62 wherein the backing 64 may be made of a plywood material. The exposed face 63 of the panel 50' is defined by a decorative or like material veneer 66 secured thereto in the conventional fashion.

Figure 9:
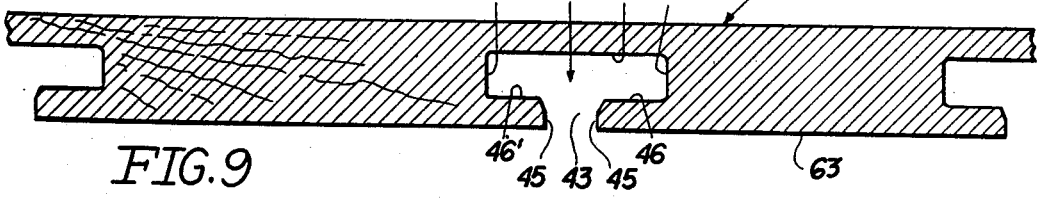
FIG. 9 is another embodiment of the panel structure of the present invention.

With regard to FIG. 9, the entire panel is formed from a single material core and is effectively one piece. It should be further noted that when a veneer such as 66 is utilized, such veneer may include a number of different materials including plastic, fabric, metal, paint, etc.

Other structural features of the present invention are best shown in FIG. 6 wherein the first connector element 82 extends through the force distribution plate 91 by means of aperture 83. Opposite sides of the aperture 83 are substantially flattened such that the aperture 83 is not round or circular. Similarly, correspondingly positioned longitudinal edges or sides of the first connecting element 82 are also flattened so as to prevent relative rotation between the first connnector element 82 and the force distribution plate 91 by means of such interengagement between flattened portions of the two components as set forth above. Further, although other structure may be contemplated, end 83 of first connector element 82 is secured to cross member 78 by means of an internally threaded aperture 76 such that rotation of the second connector element 80 causes relative movement of the first connector element 82 by virtue of this mating engagement.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. A support assembly of the type primarily designed for mounting within a panel slot having a predetermined configuration and an entrance, said support assembly comprising:

(a) a clamp assembly means for removable mounting within the panel slot and including a force distribution plate, (b) a support bar secured to said force distribution plate and extending outwardly therefrom away from the panel slot, (c) said clamp assembly means further including a first connector means movably mounted on said force distribution plate having second connector means threadably engaged therewith and a keeper bar means fixedly secured to an end of the first connector means so that said keeper bar means can be secured in clamping relation with the slot by rotating the second connector means, (d) said keeper bar means attached to said connector means and movably disposable within the panel slot relative to said force distribution plate, said keeper bar means disposable substantially transverse to a longitudinal axis of the panel slot and having a length substantially greater than the entrance to the panel slot so that opposing ends of said keeper bar bite into said slot, and (e) said connecting means selectively movable relative to said force distribution plate along with said keeper bar means and said keeper bar means cooperatively positionable with said force distribution plate into clamping relation about the entrance to the panel slot.

2. A support assembly as in claim 1 further comprising centering means mounted on said force distribution plate and structured to protrude outwardly from an inner surface of said force distribution plate into substantially mating engagement with the entrance of the panel slot.

3. A support assembly as in claim 2 wherein said centering means comprises a centering plate integrally formed on the inner surface of said force distribution plate and extending outwardly therefrom, said centering plate including a substantially elongated configuration disposed in substantially aligned relation with said first connecting element and spaced therefrom, said connecting plate further including a width less than that of an entrance to the panel slot, said centering plate disposed and configured for substantially mating, registered relation to the panel slot entrance.

4. A support assembly as in claim 1 wherein said keeper bar means has a width less than the entrance of the panel slot.

5. A combination mounting panel and support assembly secured thereto, said combination comprising:

(a) said mounting panel including at least one vertically oriented slot extending along a predetermined length thereof, (b) said one slot including entrance means of a predetermined length and width disposed contiguous an exposed surface of said mounting panel, (c) said one slot including an interior defined by a pocket portion of substantially common cross sectional dimension extending along the length thereof, (d) said pocket portion including spaced apart side faces, a rear face, and a front face, a distance between said side faces comprising an interior width of said pocket portion, (e) said entrance means disposed in direct communicating relation with said pocket portion and extending along a length thereof, said width of said pocket portion being of predetermined greater dimension than said width of said entrance means, (f) said support means including a force distribution plate disposable in flush, overlying relation to said entrance means and including a transverse dimension substantially greater than said width of said entrance means, (g) connecting means movably secured to said force distribution plate and extending into said pocket portion through said entrance means, (h) keeper bar means secured to said connecting means and positionable relative to said force distribution plate into and out of clamping relation to said front face of said pocket portion upon selective movement of said connecting means, (i) said keeper bar means having a length disposable substantially transverse to the length of both said pocket portion and said entrance means and said keeper bar length being greater than said width of said entrance means, (j) a support bar secured to said force disrribution plate and extending outwardly from an exposed surface thereof, and (k) said keeper bar means and said force distribution plate cooperatively mounted relative to said connecting means so as to selectively clamp and mount said support bar on said mounting panel contiguous said one slot upon selective positioning of said connecting means.

6. A combination as in claim 5 wherein said mounting panel includes a plurality of vertically oriented slots disposed in substantially parall predetermined spaced relation to one another, each of said slots including entrance means of predetermined width disposed contiguous an exposed surface of said mounting panel, and further including an interior defined by a pocket portion of substantially common cross sectional dimension extending along the length thereof, said pocket portion including spaced apart side faces, a rear face and a front face, a distance between said side faces comprising an interior width of said pocket portion; said entrance means disposed in direct communicating relation with said pocket portion extending along the length thereof, said width of said pocket portion being of predetermined greater dimension than said width of said entrance means.

7. A combination as in claim 6 wherein said entrance means of each slot includes a throat portion extending along the length thereof and at least partially defined by lip portions being spaced apart a common distance along the length thereof, said common distance defining said width of said entrance means and the dimension thereof being a predetermined amount less than said width of said pocket portion.

8. A combination as in claim 7 wherein said connecting means comprises a first connecting element connected to said force distribution plate and extending therefrom into an interior of the panel slot into communicating relation with said keeper bar means, said first connecting element selectively movable relative to said force distribution plate and said keeper bar means positionable towards and away from said force distribution plate and said keeper bar means positionable towards and away from said force distribution plate into and out of clamping relation to the supporting panel.

9. A combination as in claim 8 wherein said first connecting element extends through said force distribution plate and is movable relative thereto on its own longitudinal axis; said keeper bar means fixedly secured to said first connector means and movable therewith relative to said force distribution plate.

10. A combination as in claim 9 wherein said connecting means further comprises a second connecting element movably secured to said first connecting element, said first and said second connecting elements disposed in mating engagement with one another and cooperatively structured for driving interconnection with said keeper bar means for positioning the latter into and out of clamping relation to a support panel with said force distribution plate.

11. A combination as in claim 10 wherein said keeper bar means comprises a single keeper bar element fixedly secured to a distal end of said first connecting element and substantially transversely disposed relative to the length of the panel slot and having a length substantially greater than an entrance to the panel slot and the width of said pocket portion.

12. A combination as in claim 11 further comprising centering means mounted on said force distribution plate and structured to protrude outwardly from an inner surface of said force distribution plate into substantially mating engagement with an entrance of said entrance means.

13. A combination as in claim 12 wherein said centering means comprises a centering plate integrally formed on the inner surface of said force distribution plate and extending outwardly therefrom, said centering plate including a substantially elongated configuration disposed in substantially aligned relation with said first connecting element and spaced therefrom, said connecting plate further including a width less than that of an entrance to the panel slot, said centering plate disposed and configured for substantially mating registered relation to said entrance means.

14. A combination as in claim 4 wherein said keeper bar means has a width less than the width of said entrance means.

* * * * *